US010221596B1

(12) United States Patent
Cruz Lopez et al.

(10) Patent No.: US 10,221,596 B1
(45) Date of Patent: Mar. 5, 2019

(54) TELESCOPIC TRUNK LID SUPPORT DEVICE

(71) Applicant: GM GLOBAL TECHNOLOGY OPERATIONS LLC, Detroit, MI (US)

(72) Inventors: Jairo Abraham Cruz Lopez, Mexico (MX); Carlos Fernando Rendon Martinez, Toluca (MX); Jair Ivan Gutierrez Cabrera, Toluca (MX)

( * ) Notice: Subject to any disclaimer, the term of this patent is extended or adjusted under 35 U.S.C. 154(b) by 0 days.

(21) Appl. No.: 15/785,718

(22) Filed: Oct. 17, 2017

(51) Int. Cl.
*E05D 1/04* (2006.01)

(52) U.S. Cl.
CPC ..... *E05D 1/04* (2013.01); *E05D 2001/045* (2013.01); *E05Y 2900/548* (2013.01)

(58) Field of Classification Search
CPC ..... E05D 1/04; E05D 2001/045
See application file for complete search history.

(56) References Cited

U.S. PATENT DOCUMENTS 2,231,550 A * 2/1941 Schallis ..... E05C 17/085 217/60 F
2,233,882 A * 3/1941 Bobek ..... E05C 17/38 16/348
2,253,561 A * 8/1941 Harden ..... E05C 17/085 217/60 F
2,770,834 A * 11/1956 Saverio ..... E05D 1/04 16/250
2,775,781 A * 1/1957 Morgan ..... A47B 41/02 16/86 C
2,916,176 A * 12/1959 Widmer ..... E05C 17/30 217/60 F
2,947,025 A * 8/1960 Campbell ..... E05D 1/04 16/275
3,319,993 A * 5/1967 Riley, Jr. ..... E05F 1/1058 16/70
4,554,700 A * 11/1985 Lyman ..... A47L 9/00 15/323
4,683,614 A * 8/1987 Anderson ..... E05D 1/04 16/362
4,925,230 A * 5/1990 Shelton ..... E05C 17/30 16/DIG. 10
5,050,270 A * 9/1991 Burgei ..... E05D 1/04 16/298
5,061,023 A * 10/1991 Soubliere ..... E05D 1/04 16/355

(Continued)

FOREIGN PATENT DOCUMENTS

DE 102010019548 A1 11/2011
WO 2017212213 A1 12/2017

OTHER PUBLICATIONS

German Office Action for application No. 10 2018 125 552.7 dated Nov. 27, 2018 (7 pages).

*Primary Examiner* — Jeffrey O'Brien

(57) ABSTRACT

One general aspect includes a trunk lid support device, including: a gooseneck member with a first end and a second end, where the first end is configured to couple to an interior sidewall of an automotive trunk and the second end is configured to couple to an automotive trunk lid; where the gooseneck member includes: a base assembly of a hollow construction located at the first end and configured to couple to the interior sidewall, an intermediate segment of a hollow construction, and a connection segment located at the second end.

6 Claims, 6 Drawing Sheets

(56) References Cited

U.S. PATENT DOCUMENTS 5,208,945 A * 5/1993 Dodd ..... E05D 1/04 16/358
5,220,951 A * 6/1993 Dagenais ..... E05D 1/04 160/199
5,238,213 A * 8/1993 Pool ..... E05C 17/047 248/352
5,465,557 A * 11/1995 Harte ..... B65B 31/02 16/289
5,544,449 A * 8/1996 Amelio ..... B64C 1/1407 16/352
5,946,774 A * 9/1999 Ramsey ..... E05D 1/04 16/355
6,292,981 B1 * 9/2001 Ford ..... E05D 1/04 16/357
6,447,043 B1 * 9/2002 VandenHeuvel ..... B62D 25/12 16/353
6,637,797 B2 * 10/2003 Baik ..... E05F 1/1091 296/76
7,210,200 B2 * 5/2007 Hoffman ..... B60J 5/0472 16/367
7,784,155 B2 * 8/2010 Hoffman ..... E05D 3/10 16/367
7,832,057 B2 * 11/2010 Hoffman ..... E05D 3/06 16/287
8,108,971 B2 * 2/2012 Florek ..... E05D 1/04 16/193
8,251,431 B2 * 8/2012 Nakazato ..... E05D 5/062 296/146.11
8,763,206 B1 * 7/2014 Gong ..... E05D 1/04 16/355
9,382,736 B2 * 7/2016 Tejima ..... E05D 1/04
9,512,655 B2 * 12/2016 Kuo ..... E05D 1/04
9,988,812 B2 * 6/2018 Kalinowski ..... E05D 11/1007
10,066,429 B2 * 9/2018 Park ..... E05D 1/04
2005/0183834 A1 * 8/2005 Smallwood ..... E05D 1/04 160/229.1
2007/0245525 A1 * 10/2007 Hoffman ..... B60J 5/0472 16/367
2018/0129253 A1 * 5/2018 Siddiqui ..... E05D 1/04

* cited by examiner

TELESCOPIC TRUNK LID SUPPORT DEVICE

INTRODUCTION

Trunk lids (decklids) that cover vehicle trunks are generally connected by a pair of laterally spaced hinges. One such hinge that may be used is of the gooseneck member variety because they allow full range of motion from an open position to a closed position and for counter-balancing the trunk lid weight. However, these goose-neck members can require significant space within the trunk compartment that may be better suited for other vehicle components such as, for example, electronic modules. It is therefore desirable to provide a gooseneck member which requires less space in the trunk compartment to allow more room for other vehicle components.

SUMMARY

One general aspect includes a trunk lid support device, including: a gooseneck member with a first end and a second end, where the first end is configured to couple to a body and the second end is configured to couple to a trunk lid; and where the gooseneck member includes a plurality of segments having a telescoping construction.

Implementations may include one or more of the following features. The support device where the body is an interior sidewall of an automotive trunk. The support device where the plurality of segments include: a base assembly located at the first end of the gooseneck member and configured to couple to the body, an intermediate segment, a connection segment located at the second end of the gooseneck member. The support device where each of the plurality of segments is of a hollow construction. The support device where: the base assembly has a first diameter; the intermediate segment has a second diameter, the intermediate segment is configured to slidably move in the first diameter of the base assembly; and the connection segment has a third diameter, the connection segment configured to slidably move in the second diameter of the intermediate segment. The support device where the gooseneck member is constructed of metal, plastic, or fiberglass.

One general aspect includes a trunk lid support device, including: a gooseneck member with a first end and a second end, where the first end is configured to couple to an interior sidewall of an automotive trunk and the second end is configured to couple to an automotive trunk lid; where the gooseneck member includes: a base assembly of a hollow construction located at the first end and configured to couple to the interior sidewall, an intermediate segment of a hollow construction, and a connection segment located at the second end.

Implementations may include one or more of the following features. The support device where: the base assembly has a first diameter; the intermediate segment has a second diameter, the intermediate segment configured to move telescopically in the first diameter of the base assembly; and the connection segment has a third diameter, the connection segment configured to move telescopically in the second diameter of the intermediate segment. The support device where the gooseneck member is constructed of metal, plastic, or fiberglass.

One general aspect includes a method of installing a gooseneck member to an interior sidewall of an automotive trunk, the method including: providing a gooseneck member with a first end and a second end, where the gooseneck member includes: a base assembly of a hollow construction located at the first end, an intermediate segment of a hollow construction, and a connection segment located at the second end; coupling the base assembly to the interior sidewall of the automotive trunk; allowing the intermediate segment to move telescopically in a first diameter of the base assembly; allowing the connection segment to move telescopically in a second diameter of the intermediate segment.

Implementations may include one or more of the following features. The method further including coupling the connection segment to a trunk lid. The method where the gooseneck member is constructed of metal, plastic, or fiberglass.

The above features and advantages and other features and advantages of the present teachings are readily apparent from the following detailed description for carrying out the teachings when taken in connection with the accompanying drawings.

DETAILED DESCRIPTION

Embodiments of the present disclosure are described herein. It is to be understood, however, that the disclosed embodiments are merely examples and other embodiments can take various and alternative forms. The figures are not necessarily to scale; some features could be exaggerated or minimized to show details of particular components. Therefore, specific structural and functional details disclosed herein are not to be interpreted as limiting, but merely as a representative basis for teaching one skilled in the art to variously employ the present invention. As those of ordinary skill in the art will understand, various features illustrated and described with reference to any one of the figures can be combined with features illustrated in one or more other figures to produce embodiments that are not explicitly illustrated or described. The combinations of features illustrated provide representative embodiments for typical applications. Various combinations and modifications of the features consistent with the teachings of this disclosure, however, could be desired for particular applications or implementations.

Figure 1:
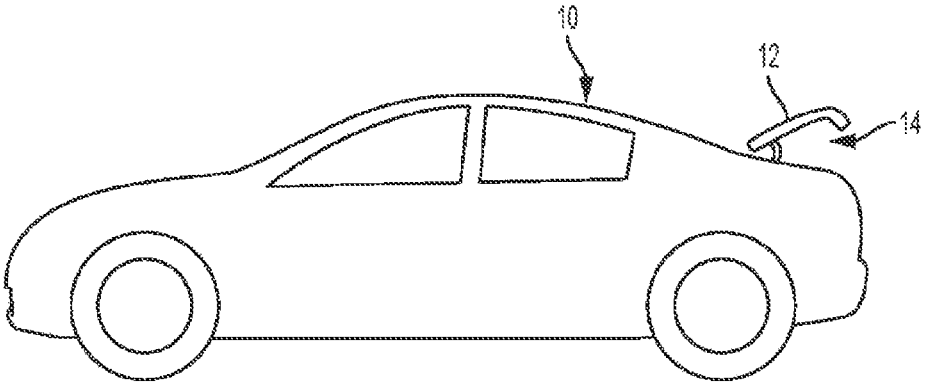
FIG. 1 is an environmental side-view of a gooseneck member according to one aspect of the present device and method.

As shown in FIG. 1, a vehicle 10 that may be an automobile has a trunk lid 12 that is coupled to the vehicle 10 via a gooseneck member 14. As a result, gooseneck 14 acts as a hinge that enables one end of the trunk lid 12 to rotatably lift away from the body of vehicle 10 while the other end remains in proximity to the vehicle 10. To accomplish this effect and support the trunk lid's weight, gooseneck 14 is required to be manufactured from a rigid material such as, but not limited to, metal, plastic, or fiberglass.

Figure 2:
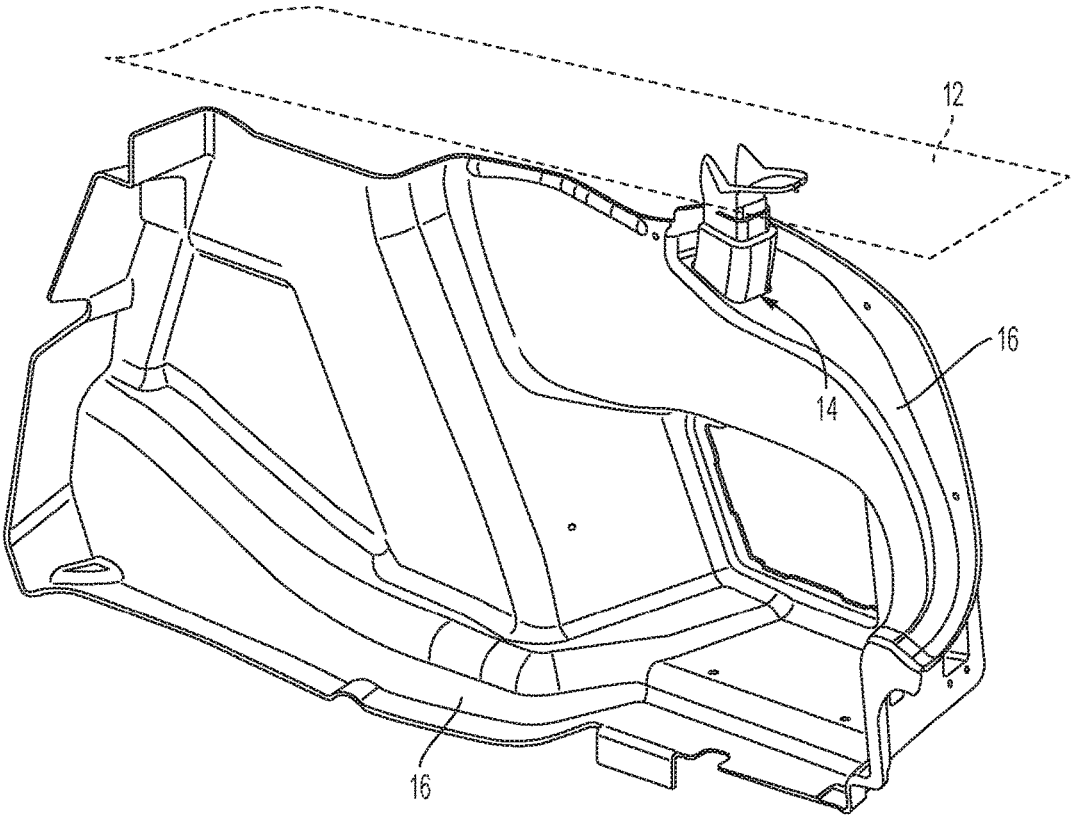
FIG. 2 is a perspective view of an exemplary gooseneck member according to an exemplary aspect of the present device and method.
Figure 3:
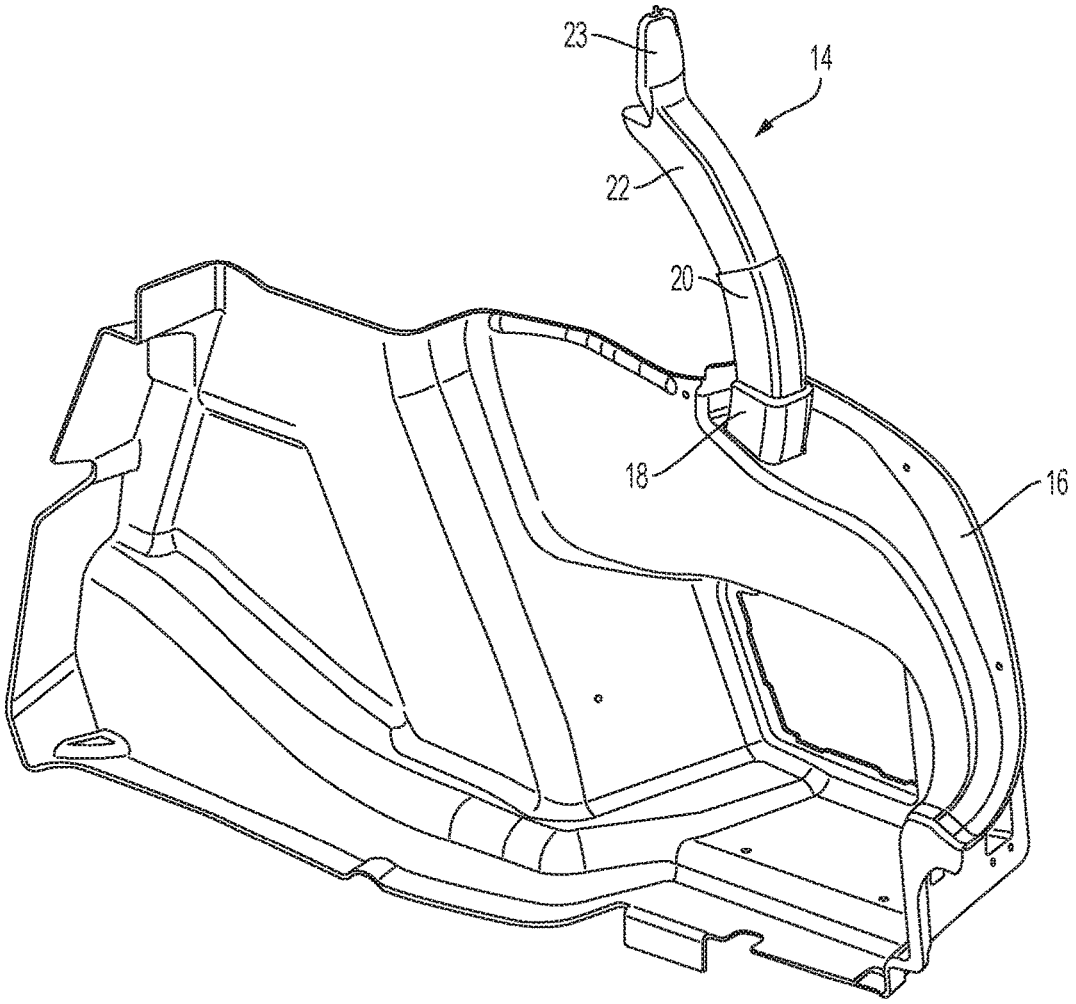
FIG. 3 is a perspective view of the exemplary gooseneck member of FIG. 2 according to another exemplary aspect of the present device and method.
Figure 4:
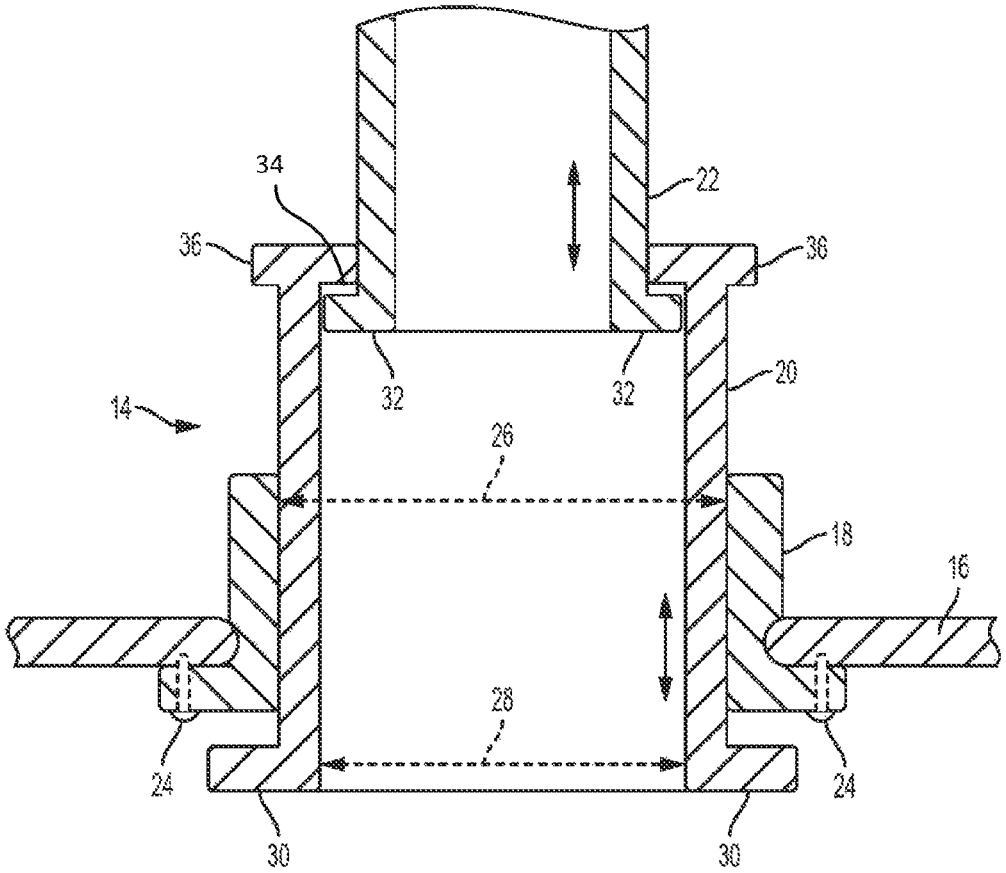
FIG. 4 shows a cutaway side view of an exemplary gooseneck member according to an exemplary aspect of the present device and method.

As shown in FIGS. 2 and 3, the gooseneck 14 is coupled at one end to an interior sidewall 16 of the trunk of vehicle 10. Whereas, the opposite end of the gooseneck 14 is coupled to the trunk lid 12. In between the first and second ends, the gooseneck 14 includes three segments—a base assembly 18, intermediate segment 20, and connection segment 22—which work in collaboration to create a telescoping construction. As such, the base assembly 18 is located at the first end of gooseneck 14 and is coupled to the interior sidewall 16 (side trim) which may be through the implementation of joining mechanisms 24 (FIG. 4). The connection segment 22 is located at the second end of gooseneck 14 and is coupled to trunk lid 12 through rotatable arm joint 23. Intermediate segment 20 is thus interposed in between base assembly 18 and connection segment 22. It should be understood the gooseneck member 14 may include more segments than the three as shown herein.

Figure 5:
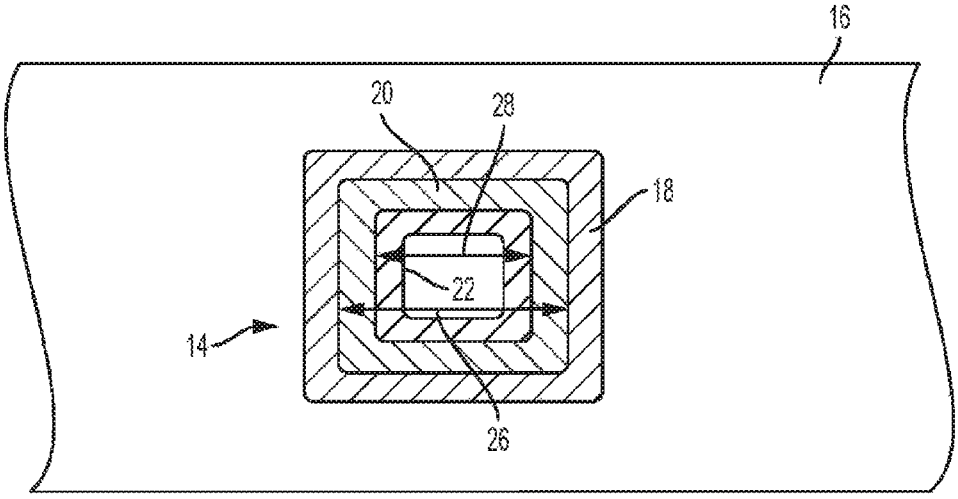
FIG. 5 shows a cutaway top-down view of an exemplary gooseneck member according to an exemplary aspect of the present device and method.

As shown in FIGS. 4 and 5, each of the segments 18, 20, 22 have a hollow construction. In this embodiment, the base assembly 18 includes a first diameter 26 that is wide enough to allow the intermediate segment 20 to slidably move throughout the hollow space (in the substantially vertical direction) so as to create telescopic movement of this segment 20. The bottom end of the intermediate segment 20 may also include an external lip 30, which is wider than the first diameter 26, in order to restrict the intermediate segment 20 from sliding out of base assembly 18. In addition, the top end of intermediate segment 20 may include a second external lip 36 to prevent the segment from falling through base assembly 18 and into the confines of a cavity behind interior sidewall 16. Moreover, the intermediate segment 20 includes a second diameter 28 that is wide enough to allow the connection segment 22 to slidably move throughout the hollow space (in the substantially vertical direction) so as to create telescopic movement of this segment 22. The bottom end of the connection segment 22 may also include an external lip 32, which is wider than an internal lip 34 of intermediate segment 20, in order to restrict the connection segment 22 from sliding out of intermediate segment 20. The top end of the connection segment 22 may also include a lip on the opposite, external, side (not shown). It should be understood the connection segment 22 does not necessarily require a hollow construction. In certain embodiments, not shown, the telescoping segments 18, 20, 22 can be provided with a tongue and groove arrangement to prevent rotation.

Figure 6:
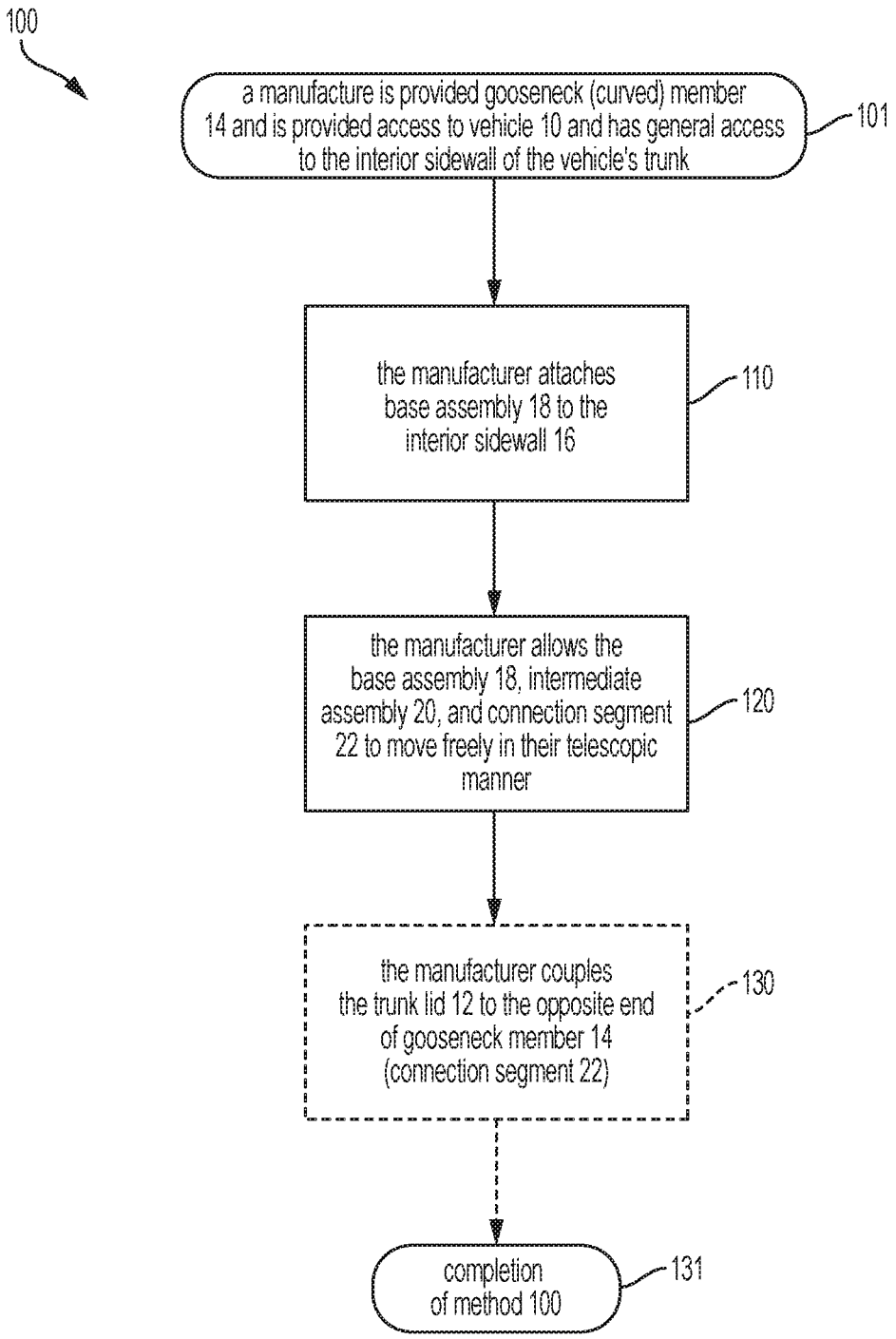
FIG. 6 shows a flowchart depicting one exemplary embodiment of a method of installing an exemplary gooseneck member.

As shown in FIG. 6, a method of installing an embodiment of a gooseneck member 14 onto an interior sidewall 16 is generally represented by reference numeral 100. Method 100 begins with 101 in which a manufacturer is provided a gooseneck member 14 having a normal construction as well as vehicle 10 and general access to the trunk interior side wall 16. In step 110, the manufacturer attaches base assembly 18 to the interior sidewall 16 which may be through the implementation of joining mechanisms 24 (e.g., bolts, screws, rivets, etc.). In step 120, the manufacture allows the segments 18, 20, 22 to freely move in their normal telescopic manner—as discussed above. In this step, the manufacturer should ensure that nothing restricts the movement of the gooseneck member 14 while it is being operatively extended or retracted. In an optional step 130, the manufacture couples the trunk lid 12 to the opposite end of gooseneck member 14. When gooseneck member 14 is adequately installed onto the interior sidewall 16 method 100 moves to completion 131.

While exemplary embodiments are described above, it is not intended that these embodiments describe all possible forms encompassed by the claims. The words used in the specification are words of description rather than limitation, and it is understood that various changes can be made without departing from the spirit and scope of the disclosure. As previously described, the features of various embodiments can be combined to form further embodiments of the invention that may not be explicitly described or illustrated. While various embodiments could have been described as providing advantages or being preferred over other embodiments or prior art implementations with respect to one or more desired characteristics, those of ordinary skill in the art recognize that one or more features or characteristics can be compromised to achieve desired overall system attributes, which depend on the specific application and implementation. These attributes can include, but are not limited to cost, strength, durability, life cycle cost, marketability, appearance, packaging, size, serviceability, weight, manufacturability, ease of assembly, etc. As such, embodiments described as less desirable than other embodiments or prior art implementations with respect to one or more characteristics are not outside the scope of the disclosure and can be desirable for particular applications.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

None of the elements recited in the claims are intended to be a means-plus-function element within the meaning of 35 U.S.C. § 112(f) unless an element is expressly recited using the phrase "means for" in the claim.

What is claimed is:

1. A trunk lid support device, comprising:

a curved member with a first end and a second end, wherein the first end is configured to couple to an interior sidewall and the second end is configured to couple to a trunk lid; and wherein the curved member comprises a plurality of segments having a telescoping construction, wherein the plurality of segments include:

a base assembly comprising a first diameter, the base assembly located at the first end of the curved member and configured to couple to the interior sidewall via one or more joining mechanisms;

an intermediate segment configured to slidably move within the first diameter of the base assembly, the intermediate segment comprising:

a second diameter;

a first external lip located at a first end of the intermediate segment and being wider than the first diameter so as to restrict at least part of the slidable movement of the intermediate segment within the first diameter of the base segment in a first direction;

a second external lip located at a second end of the intermediate segment and being wider than the first diameter so as to restrict at least part of the slidable movement of the intermediate segment within the first diameter of the base segment in a second direction;

and an internal lip; and a connection segment located at the second end of the curved member and configured to slidably move within the second diameter of the intermediate segment, and the connection segment comprising a third external lip that is wider than the internal lip of the intermediate segment so as to restrict at least part of the slidable movement of the connection segment within the second diameter of the intermediate segment.

2. The support device of claim 1, wherein the curved member is constructed of metal, plastic, or fiberglass.

3. A trunk lid support device coupled directly to an interior sidewall of an automotive trunk, comprising:

a curved member with a first end and a second end, wherein the first end is configured to couple directly to the interior sidewall of the automotive trunk and the second end comprising a rotatable arm joint to couple to the automotive trunk lid;

wherein the curved member comprises:

a base assembly of a hollow construction located at the first end and configured to couple directly to the interior sidewall via one or more joining mechanisms, the base assembly comprising a first diameter;

an intermediate segment of a hollow construction, the intermediate segment configured to slidably move within the first diameter of the base assembly, the intermediate segment comprising:

a second diameter;

a first external lip located at a first end of the intermediate segment and being wider than the first diameter so as to restrict at least part of the slidable movement of the intermediate segment within the first diameter of the base assembly in a first direction;

a second external lip located at a second end of the intermediate segment and being wider than the first diameter so as to restrict at least part of the slidable movement of the intermediate segment within the first diameter of the base assembly in a second direction;

and an internal lip; and a connection segment located at the second end, the connection segment configured to slidably move within the second diameter of the intermediate segment, and the connection segment comprising a third external lip that is wider than the internal lip of the intermediate segment so as to restrict at least part of the slidable movement of the connection segment within the second diameter of the intermediate segment.

4. The support device of claim 3, wherein the curved member is constructed of metal, plastic, or fiberglass.

5. A method of installing a curved member to an interior sidewall of an automotive trunk, the method comprising:

providing a curved member with a first end and a second end, wherein the curved member comprises:

a base assembly of a hollow construction located at the first end, the base assembly comprising a first diameter;

an intermediate segment of a hollow construction, the intermediate segment configured to slidably move within the first diameter of the base assembly, the intermediate segment comprising:

a second diameter;

a first external lip located at a first end of the intermediate segment and being wider than the first diameter so as to restrict at least part of the slidable movement of the intermediate segment within the first diameter of the base assembly in a first direction;

a second external lip located at a second end of the intermediate segment and being wider than the first diameter so as to restrict at least part of the slidable movement of the intermediate segment within the first diameter of the base assembly in a second direction;

and an internal lip; and a connection segment located at the second end and configured to slidably move within the second diameter of the intermediate segment, and the connection segment comprising a rotatable arm joint and a third external lip that is wider than the internal lip of the intermediate segment so as to restrict at least part of the slidable movement of the connection segment within the second diameter of the intermediate segment;

coupling the base assembly directly to the interior sidewall of the automotive trunk via one or more joining mechanisms;

allowing the intermediate segment to slidably move within the first diameter of the base assembly;

allowing the connection segment to slidably move within the second diameter of the intermediate segment; and coupling the connection segment to a trunk lid via the rotatable arm joint.

6. The method of claim 5, wherein the curved member is constructed of metal, plastic, or fiberglass.

* * * * *